US010116046B1

(12) United States Patent
Fritzel et al.

(10) Patent No.: US 10,116,046 B1
(45) Date of Patent: Oct. 30, 2018

(54) VEHICLE OUTDOOR ELECTRONICS CABINET

(71) Applicants: Michael Phillip Fritzel, Keller, TX (US); Patrick Joseph Fritzel, Keller, TX (US); Mark Stephen Lohmar, Keller, TX (US); Matthew Robert Hart, Denton, TX (US)

(72) Inventors: Michael Phillip Fritzel, Keller, TX (US); Patrick Joseph Fritzel, Keller, TX (US); Mark Stephen Lohmar, Keller, TX (US); Matthew Robert Hart, Denton, TX (US)

( * ) Notice: Subject to any disclaimer, the term of this patent is extended or adjusted under 35 U.S.C. 154(b) by 690 days.

(21) Appl. No.: 14/716,809

(22) Filed: May 19, 2015

(51) Int. Cl.
*H01Q 1/32* (2006.01)

(52) U.S. Cl.
CPC ..... *H01Q 1/3275* (2013.01)

(58) Field of Classification Search
USPC ..... 343/711; 174/520, 58
See application file for complete search history.

(56) References Cited

U.S. PATENT DOCUMENTS 3,282,660 A * 11/1966 Pendleton ..... B23K 20/227 228/131
3,836,696 A * 9/1974 Gressitt ..... H02G 15/10 174/41
4,626,810 A * 12/1986 Nixon ..... H01B 11/1821 156/244.11
7,492,318 B2 * 2/2009 Duzdar ..... H01Q 1/3275 343/711
9,496,624 B2 * 11/2016 Juan ..... H01Q 21/26
2008/0111752 A1 * 5/2008 Lindackers ..... H01Q 1/3275 343/713
2010/0315301 A1 * 12/2010 Marten ..... H01Q 1/3275 343/713

* cited by examiner

*Primary Examiner* — William H Mayo, III
*Assistant Examiner* — Krystal Robinson
(74) *Attorney, Agent, or Firm* — Guy V. Manning

(57) ABSTRACT

An antenna farm enclosure for a locomotive cab includes a planar lid hinged to a base and bearing an array of compact antennae. A separate frame holds the antenna farm above the roof to permit wind and moisture to pass beneath, and allows for adjustments for irregularities in the cab roof. A chimney surrounding a port through the cab roof extends upward into the antenna farm enclosure, forming a dam that prevents accumulated moisture from entering the cab or the enclosure. Cables from the antennae extend through the chimney into the cab. A wide flange surrounds the lid and bears against two concentric gaskets to seal the enclosure. Specialized hold-down devices arrayed around the flange compress both gaskets, and comprise threaded shafts hingedly coupled to the base. The slightly arched flange asserts spring-like tension against the hold-down devices, which compress the arched flange to strengthen the seal.

27 Claims, 8 Drawing Sheets

104
103
102
107
105
101
106

107
105
101
106
103

107
105
101
103
102
106

VEHICLE OUTDOOR ELECTRONICS CABINET

BACKGROUND OF THE INVENTION

1. Field of the Invention

This invention relates generally to vehicle communications systems, and specifically to outdoor cabinets mounted on vehicles and adapted to contain electronics and electrical equipment. More particularly, this invention relates to such a cabinet disposed on the top of railroad vehicles. Still more particularly, this invention relates to a removable, moisture and wind leakage resistant compartment for communication antennae atop railroad engines.

2. Description of Related Art

Recent development of Positive Train Control (PTC) for railroad trains promotes functional monitoring and control of moving trains. It includes one or more of several capabilities: train separation or collision avoidance, line speed enforcement, temporary speed restrictions and rail worker wayside safety. Most of such functionalities are achieved remotely through radio and microwave communication between the moving train and stationary objects or personnel.

To such end, recent generations of new train engines, and retrofitted legacy engines, increasingly include numerous antennae positioned on the roof of the engine cab. Conventional whip antennae, however, and their substantial bases are inappropriate for such applications because of required clearances between the engine car's roof and environmental obstacles such as tunnels, signal gantries, crossing power lines and the like. Accordingly, a preferred antenna farm for railroad engines comprises a shallow but wide compartment affixed to the engine cab roof with compact antennae, merely inches tall, arrayed across its upper surface. The antenna farm extends only a few inches above the roof surface, and along with the engine cab roof itself, serves as a ground plane for the antennae.

Cables from the antennae communicate between the compartment interior and the engine car through one or more cable ports, usually through the compartment ceiling. Despite sealing and other measures taken to avoid it, such antenna farms are notorious for trapping and filling up with windblown water, snow and other environmental contaminants. If the antenna farm-to-engine compartment interface is not water and pressure tight, the moisture can leak into the engine cab and damage electronics and other things stored there. A need exists for an antenna farm compartment which overcomes this leakage obstacle.

Among the leakage problems with prior art devices, two stand out as particularly troublesome. First, the relatively large, flat compartment lids can become warped or damaged in use and allow leakage around their perimeters by windblown rain and other moisture sources. Secondly, moisture trapped within the antenna farm compartment often pours down the interface between the bottom of the compartment and the engine cab. A need exists for an antenna farm compartment that doesn't leak into the engine compartment.

Such antenna farms also are notorious for providing nests for insects and other fauna, sometimes particularly harmful to service technicians who open the compartments and are confronted with the intruders. Means for providing ventilation for antenna farms while excluding intruders is needed.

Railroad engine cars' roofs ideally would be relatively flat and even, but they seldom are. Positioning a wide, flat antenna farm compartment on such uneven surfaces can prove problematic. A need exists for means for coupling antenna farms to engine car roofs while keeping them horizontal.

SUMMARY OF THE INVENTION

An antenna farm enclosure for a locomotive cab includes a planar lid hinged to a base and bearing an array of compact antennae. A separate frame holds the antenna farm above the roof to permit wind and moisture to pass beneath, and allows for adjustments for irregularities in the cab roof. A chimney surrounding a port through the cab roof extends upward into the antenna farm enclosure, forming a dam that prevents accumulated moisture from entering the cab or the enclosure. Cables from the antennae extend through the chimney into the cab. A wide flange surrounds the lid and bears against two concentric gaskets to seal the enclosure. Specialized hold-down devices arrayed around the flange compress both gaskets, and comprise threaded shafts hingedly coupled to the base. The slightly arched flange asserts spring-like tension against the hold-down devices, which compress the arched flange to strengthen the seal.

BRIEF DESCRIPTION OF THE DRAWINGS

The novel features believed characteristic of the present invention may be set forth in appended claims. The invention itself, as well as a preferred mode of use and further objects and advantages thereof, will best be understood by reference to the following detailed description of an illustrative embodiment when read in conjunction with the accompanying drawings, wherein:

DESCRIPTION OF A PREFERRED EMBODIMENT

Figure 1:
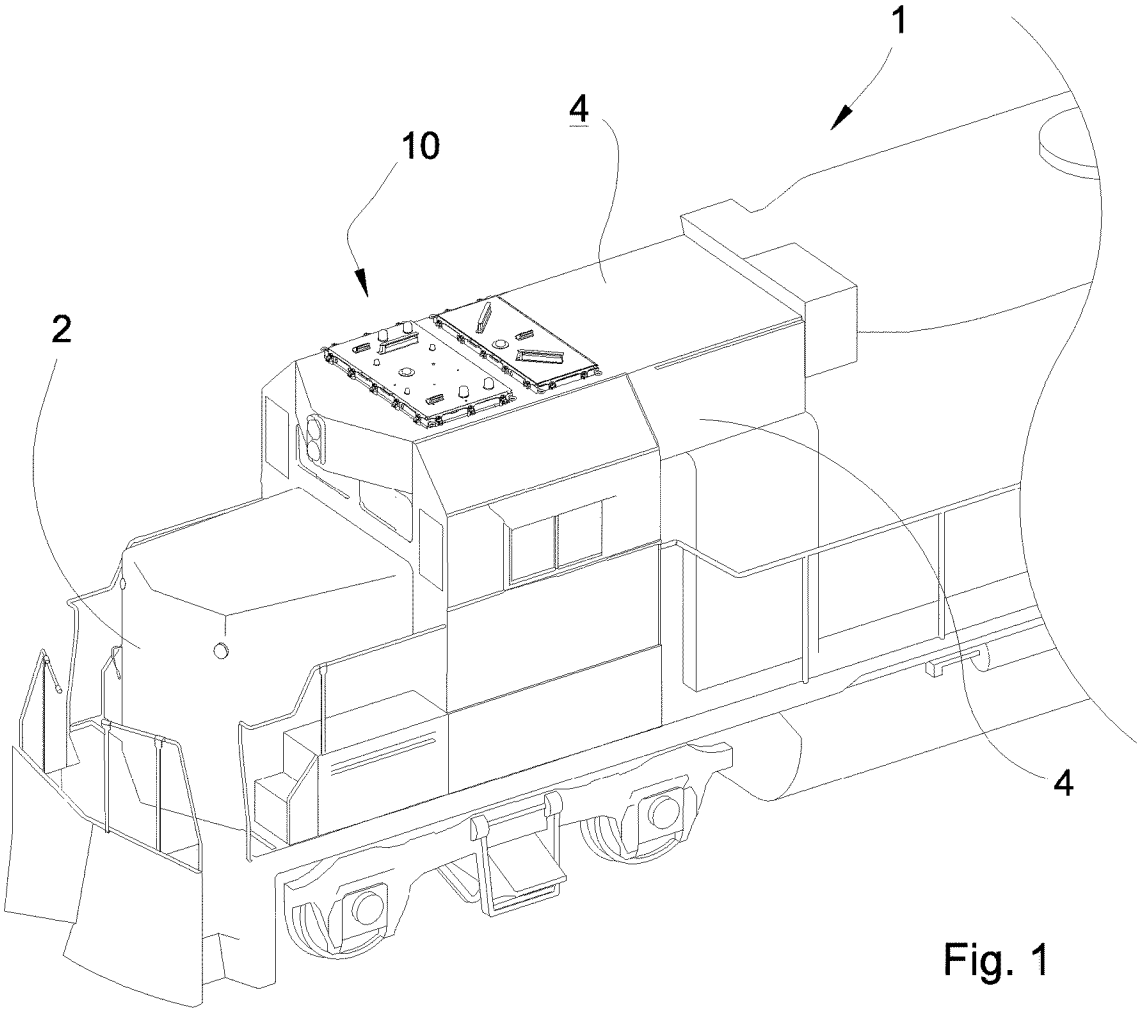
FIG. 1 shows a partial view of the front end of a typical locomotive engine bearing an antenna farm on the roof of its cab.
Figure 2:
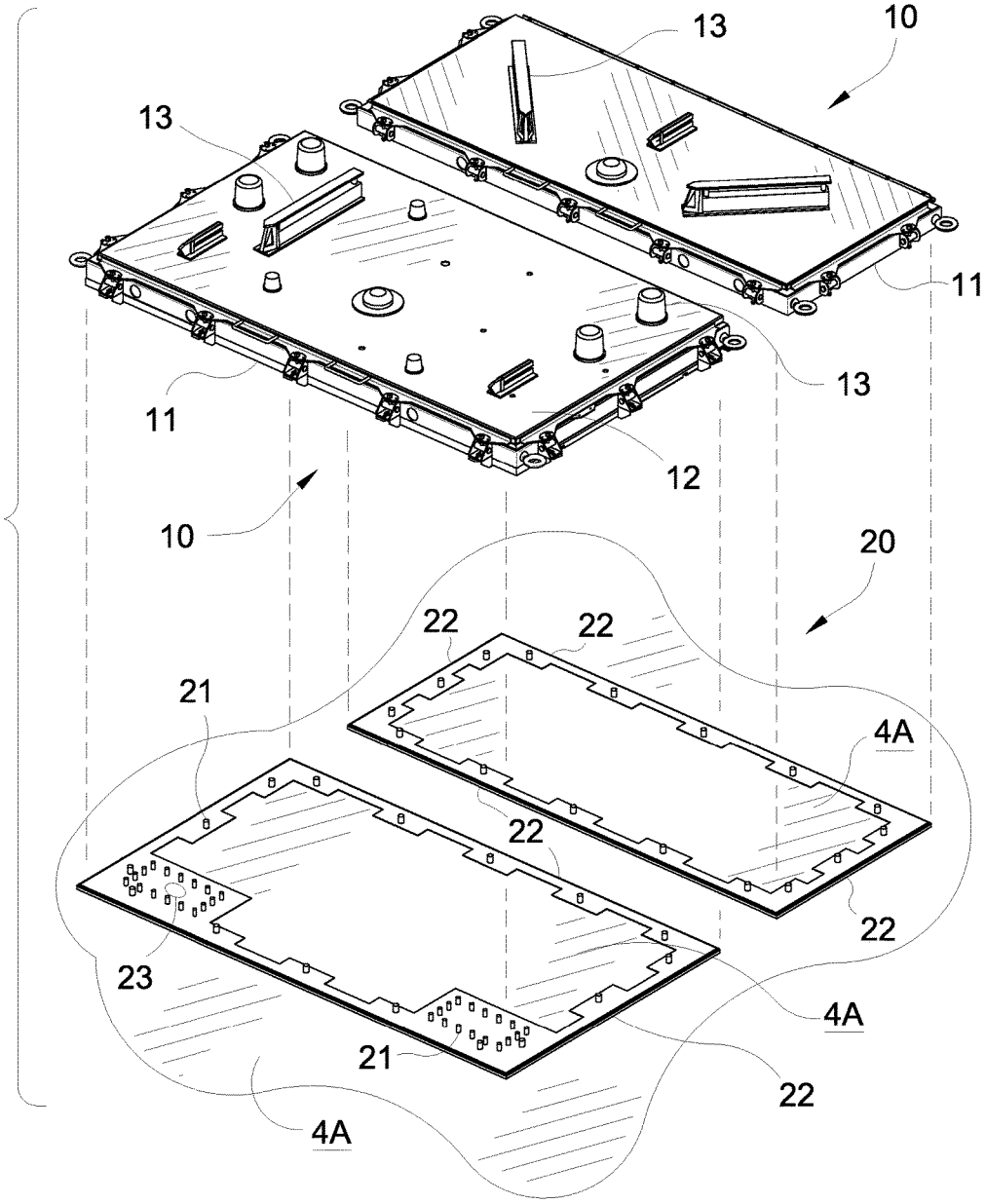
FIG. 2 depicts the antenna farm shown in FIG. 1 but expanded vertically to show the mounting system thereof.

Referring now to the figures, and particularly to FIGS. 1-2, locomotive 1 is propelled by engine 2, often but not necessarily stationed at the front of the rest of the train (not shown). Engine 2 includes cab 3 covered by substantially flat cab roof 4. Antenna farm 10 disposed atop roof 4 bears short antennae 13 on its lid 12. Antenna farm 10 depicted in the figures comprises two substantially coplanar enclosures substantially covering cab top 4, but one having ordinary skill in the art will recognize that antenna farm 10 could include any number of enclosures, either juxtaposed or dispersed.

As best seen in FIG. 2, prior art antenna farms 10 have bases 11 bolted directly to frame 20 which is permanently welded 22 to cab roof 4 of engine 2. Bolts 21 extending vertically upward from frame 20 penetrate corresponding holes (not shown) in base 11 to secure it to engine 2. Lid 12 hingedly couples to base 11 to provide a wind-resistant enclosure for cables 14 extending from the various antennae 13 to couple to appropriate electronic devices disposed within cab 3.

Figure 3:
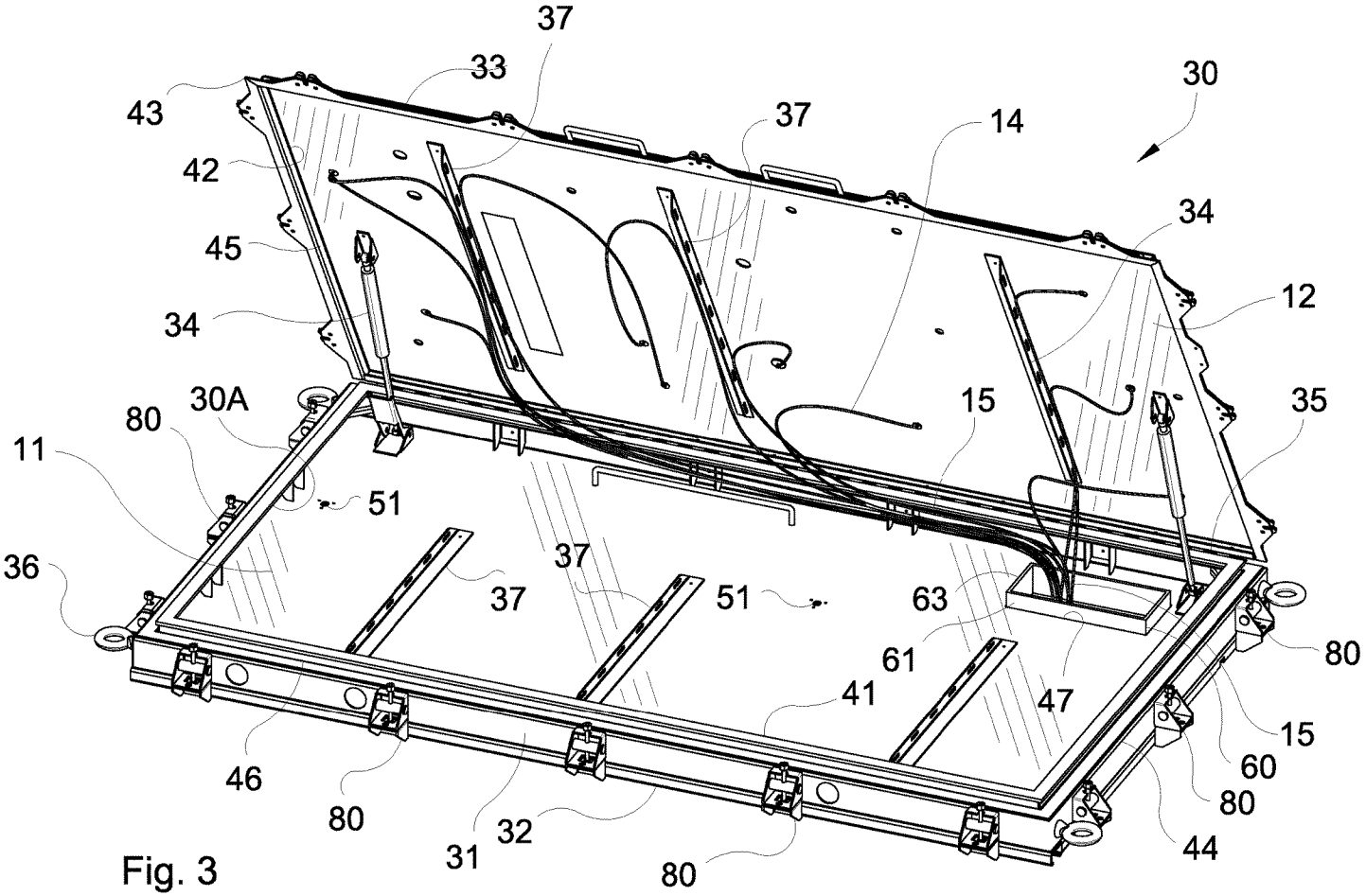
FIG. 3 details in quartering perspective the present invention of an antenna farm enclosure or cabinet, with its lid open, adapted to take the place of the prior art antenna farm of FIG. 1.

As best seen in FIG. 3, cables 14 from antennae 13 join together in one or more cable bundles 15 in at least one corner of base 11 and enter one or more ports 47 aligned with conduit 23 disposed within frame 20 and providing access into cab 3 for cable bundle(s) 15. Sealing materials (not shown) may surround bundle(s) 15 to deter penetration into cab 3 by moisture, insects or other contaminants (none shown). Enclosure 10 prevents cables 14 from blowing around and being damaged by wind created when locomotive 1 is propelled at high speeds by engine 2.

Enclosures 10 seldom are air or moisture tight, however. Subject to significant vibration, lids 12 can become loose, resulting in breach of the integrity of enclosures 10. Further, during use, cab roof 4 may undergo stresses which warp and otherwise distort it and frame 20, creating irregularities (not shown) in the surface of cab roof 4 and aggravating the fit between enclosure 10 and frame 20. Under pressure from wind, both natural and created by engine 2, snow and rain may penetrate into enclosures 10. Moisture can build up and leak through ports 47 and conduits 23 and into cab 3.

Figure 4:
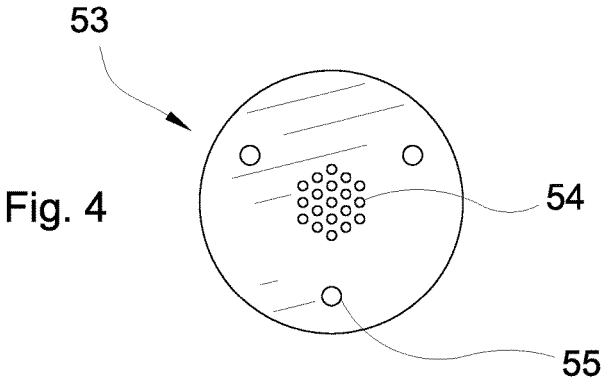
FIG. 4 details a weep hole cover used with the enclosure of FIG. 3.
Figure 5:
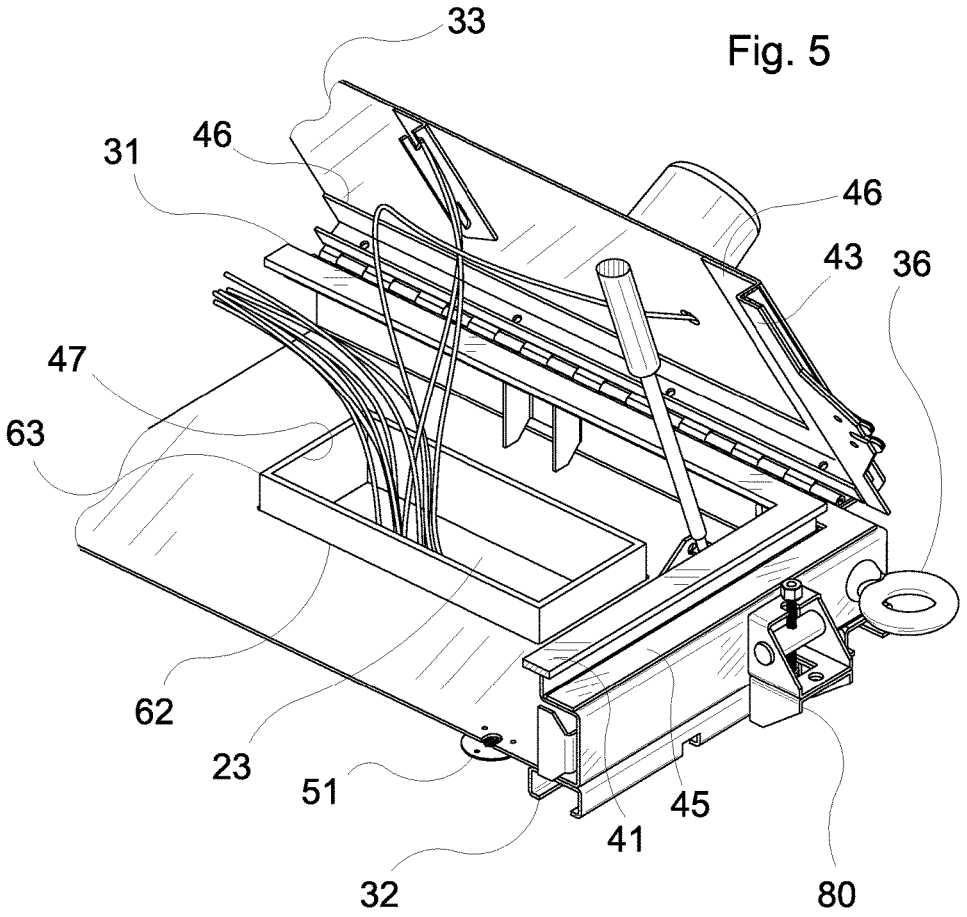
FIG. 5 details in quartering perspective a partial section of one corner of the enclosure of FIG. 3.

Turning now also to FIGS. 3-5, the present invention antenna farm 30 includes features described below which significantly improve upon this leakage problem. Similarly to prior art enclosure 10, antenna farm 30 includes wide, flat, rectangular base 31 surrounding and defining antenna farm interior 30A and to which co-extensive lid 33 couples by hinge 35 extending substantially the length of one long side of base 31. Lid 33 and base 31 include battens 37 which double as cable 14 mounts for securing cables 14 as they extend from various locations (not shown) around lid 33 to create one or more bundles 15 before entering cab 3, similarly to antenna farm 10 and discussed in more detail below. Struts 34 provide means for holding lid 33 open during servicing.

Instead of bolting directly to frame 20, however, antenna farm 30 includes its own frame 32 adapted to be attached to cab roof 4. Preferably, frame 32 comprises at least two, and more preferably four, steel C-channels disposed end to end to form a perimeter substantially congruent with the perimeter of base 31. As depicted in the figures, base 31 is rectangular in its substantially horizontal dimension, requiring frame 32 also to form a rectangular spacer between base 31 and roof 4. One having ordinary skill in the art will recognize, of course, that base 31 could have any number of other shapes, such as round, square or triangular (none shown), thereby dictating the shape and number of C-channels required to form frame 32, and that all such base 31 and frame 32 shapes are considered to be within the spirit and scope of the present invention.

Figure 6:
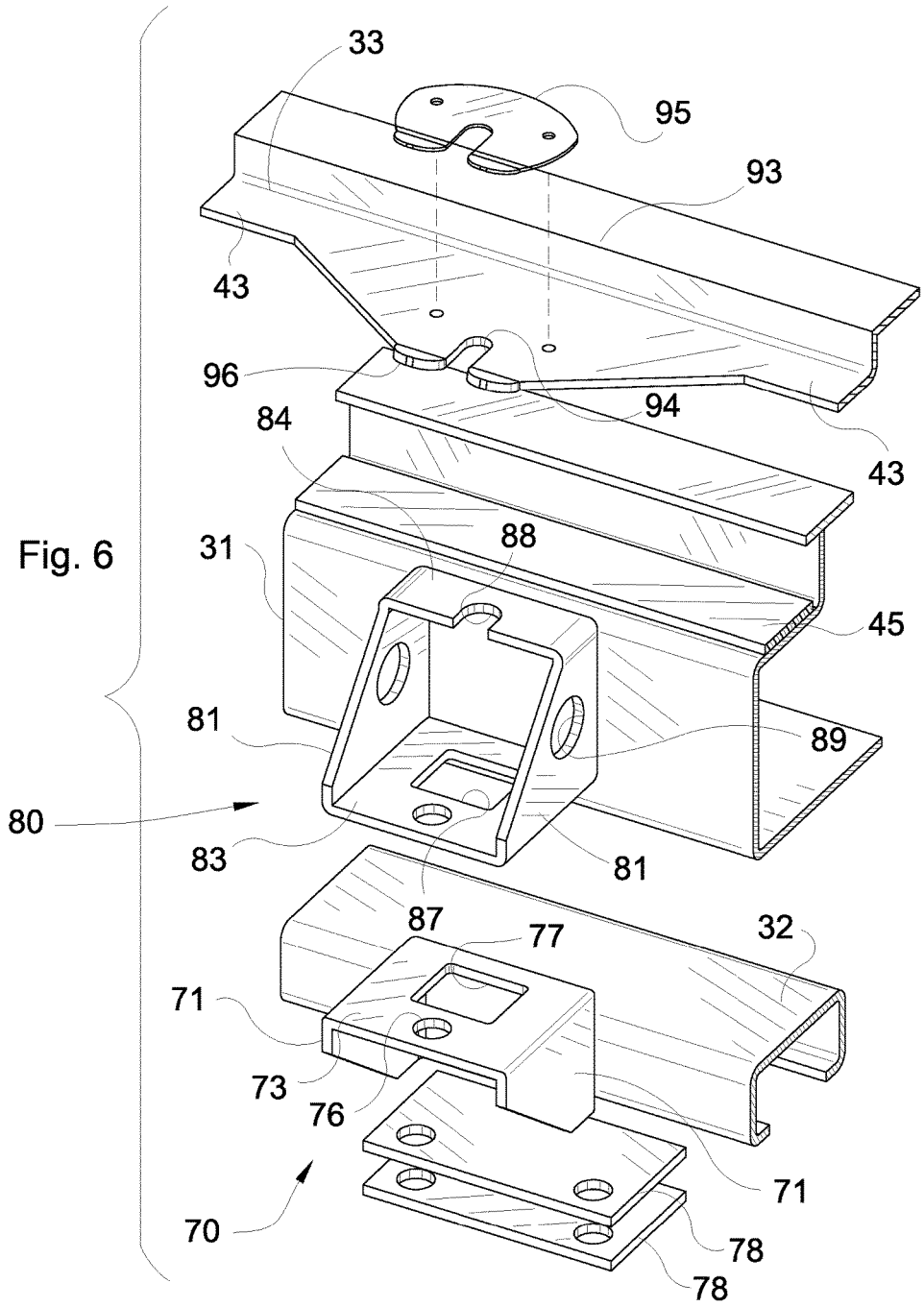
FIG. 6 shows components of an adjustable mounting block for the enclosure of FIG. 3.

Adjustable mounts 70 (see also FIG. 6) disposed at selected locations around the perimeter of frame 32 provide means for coupling base 31 of antenna farm 30 to frame 32. Mounts 70 preferably comprise two vertical gussets 71 welded to the outer perimeter wall of frame 32 and supporting mount flange 73 spanning between them. Mount bolt aperture, or bolt hole 76 substantially centered between frame gussets 71 aligns with like block bolt aperture, or bolt hole 86 (FIG. 7A) in block floor 83, as discussed below. One having ordinary skill in the art will recognize that a sufficient number of mounts 70 may be employed to create as strong a bond to frame 32 and thereby to cab top 4 as continuous weldment 22 (FIG. 2) does for permanent frame 20. By use of frame 32, however, each location may be individually fitted to cab roof 4 using one or more shims 78 to winnow out the irregularities in roof 4. One having ordinary skill in the art will recognize, too, that frame 32 may rely for attachment to cab roof 4 upon bolts 21 around the perimeter of frame 20 as appropriate where cab roof 4 already is equipped with frame 20, without the need to remove existing frame 20 or to add new bolts 21.

Frame 32 is not completely water- or wind-tight beneath base 31, but instead permits water and wind to flow below the floor of base 31. Allowing such relatively free flow of wind and moisture beneath antenna farm 30 could exacerbate leakage into cab 3, however, were it not for another feature of the present invention. Chimney 60 comprises interface means between interior 30A of antenna farm 30 and the interior of cab 3. Chimney 60 forms a dam formed by chimney walls 61 surrounding conduit 23 (FIG. 5) and extending upward therefrom through port 47 and into interior 30A of antenna farm 30 a select distance above the bottom of base 31. Mouth 63 of chimney 60 terminates below lid 33 sufficiently far to allow bundles 15 to enter mouth 63 and thereby conduit 23 on their way into cab 3. Sealing (not shown) of any gap between port 47 and walls 61 deters splashing and unnecessary moisture intrusion into the interior of antenna farm 30. Bottom 62 of chimney 60 is sealed to roof 4 by appropriate means, such as a gasket, welding or other conventional methods (none shown) to prevent moisture from entering conduit 23 directly.

Base 31 also includes weep holes 51 arrayed around its interior bottom for allowing moisture that inevitably intrudes, either by seepage or condensation, into antenna farm 30 a way to escape into the space created by frame 32 between base 31 and cab roof 4. Weep holes 51 are sized to deter significant amounts of moisture from intruding into the interior of antenna farm 30 through weep holes 51, yet to allow condensate and any other moisture that does manage to enter interior 30A of antenna farm 30 to escape.

Though the enclosure of antenna farm 30 is not intended to be air or moisture sealed, it is preferable that it remain reasonably impermeable against both the elements and intrusion by invasive fauna such as snakes and wasps. Wasp screens (see FIG. 4) disposed across weep holes 51 prevent intrusion into antenna farm 30 by various fauna and creating an unwelcome surprise to a service technician (not shown) opening lid 33 to service antenna farm enclosure 30.

Disposed around the perimeter of lid 33, wide flange 43 extends outward from recess 42 within lid 33 on all sides thereof. Flange 43 is substantially the same width as shelf 44 surrounding the perimeter of base 32. Lip 41 extends upward from the inner edge of shelf 44 to lie disposed inside recess 42 when lid 33 is closed. Continuous lid gasket 46 is disposed on the interior surface of lid 33 such that lip 41 engages and compresses it when lid 33 closes. Additionally, second continuous shelf gasket 45 lies atop shelf 44 substantially concentric, though not coplanar, with lid gasket 46. When lid 33 closes, flange 43 engages and compresses shelf gasket 45 further to prevent intrusion into antenna farm 30 between lid 33 and base 31.

Turning now also to FIGS. 6-9C, hold-down means 80 comprises adjustable mounting blocks 80 disposed around the perimeter of antenna farm 30 which cooperate with latch mechanisms 100 for retaining lid 33 tightly closed against base 31. As best seen in FIG. 3, blocks 80 are disposed at each corner on each side of base 31, with at least one additional block 80 disposed in between, including one disposed half way between each of two adjacent corners of base 31. One or more additional blocks 80 may be included in a given side as needed. Blocks 80 are designed to allow latches 100 to compress a slightly concave-downward arch in flange 43 and lid 33 between its corners, thereby compressing gaskets 45, 46. A spring-like bias against latches 100 creates resistance to opening which prevents latches 100 from coming loose during use.

Blocks 80 comprise lugs, or gussets 81 disposed on the outer edges of base 31 directly above and bolted to frame lugs 70 welded to frame 32. Gussets 81 extend upward from substantially horizontal block floor 83 to brace floor 83 against the force of closing latches 100 discussed below. Block top 84 (see FIG. 6) may span between gussets 81 to reinforce them further and to provide a positive stop against which flange 43 bears upon closing lid 33, thereby preventing over-compression of gaskets 45, 46. When latch top 84 is provided, top slot 88 is adapted to admit shaft 105 when latch 100 is closed, as discussed in more detail below.

Corresponding in location along flange 43, flare 93 extends from lid 33 to substantially cover top 84 of lug 81. It includes flare nose 96 surrounding and defining flare slot 94 disposed coaxially above top slot 88 and adapted also to admit shaft 105. Flare 93 is concave slightly upward, away from top 84, at nose 96 to capture tightening nut 107 and prevent shaft 105 from slipping out of slots 88, 94 when latch 100 is closed and tightened, as discussed below. Flare 93 further includes slotted washer 95 atop nose 96 to reinforce nose 96 and to absorb and deter wearing of nose 96 from repeated turning of tightening nut 107, as discussed above. Washer 95 preferably is fabricated from hardened steel and may be replaced as needed.

Figure 7B:
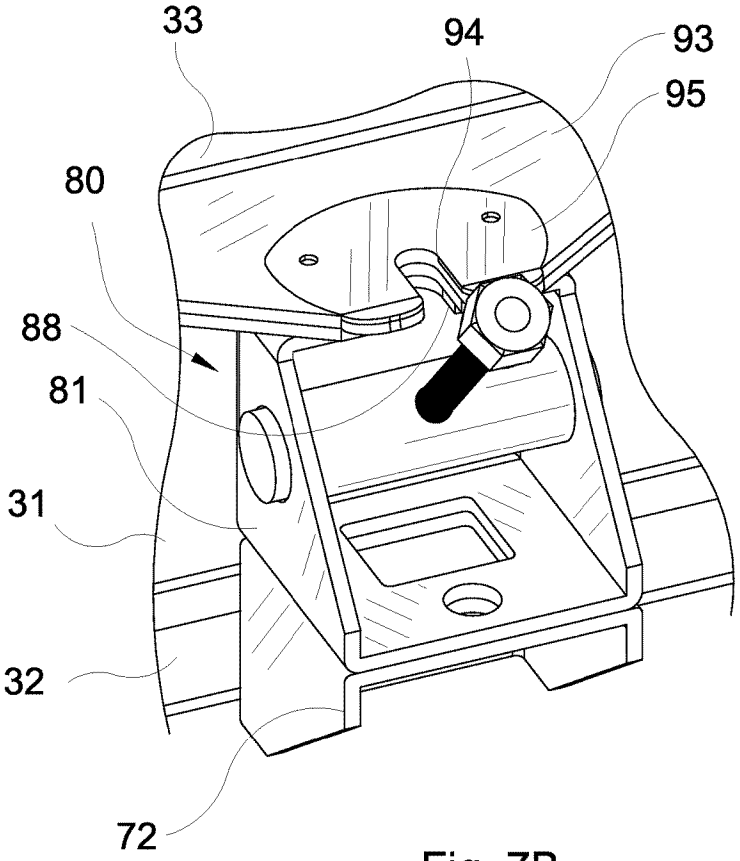
FIG. 7A detail a hold down latch used with the adjustable mounting block of FIG. 6.

Latch 100 provides closure and tightening means for blocks 80. As mentioned above, threaded shaft 105 extends through slots 88, 94 when block 80 is closed, and tightening nut 107 turns shaft 105 to tighten latch 100. Axle 101 is coaxial with and journaled within transverse apertures 89 of gussets 81 and adapted to rotate freely about a transverse axis substantially parallel to flange 43. Collar 103 has an interior diameter just large enough to receive axle 101 journaled within its interior, but too large to go through apertures 89. When latch 100 is assembled, collar 103 thus is disposed along axle 101 between gussets 81 and prevents axle 101 from slipping axially out of one of apertures 89 and reinforces axle 101 to deter it from deflecting upward under tension in shaft 105. Threaded bore 102 through axle 101 is sized and threaded to receive shaft 105 journaled within its interior, and to permit adjustment of the length of shaft 105 extending toward flare 93. Cap 106 is affixed to the lower end of shaft 105 opposite nut 107 and prevents shaft 105 from being unscrewed out of axle 101, thereby preventing it from becoming lost from latch 100 when hold down block 80 is opened (FIG. 7B).

Figure 7A:
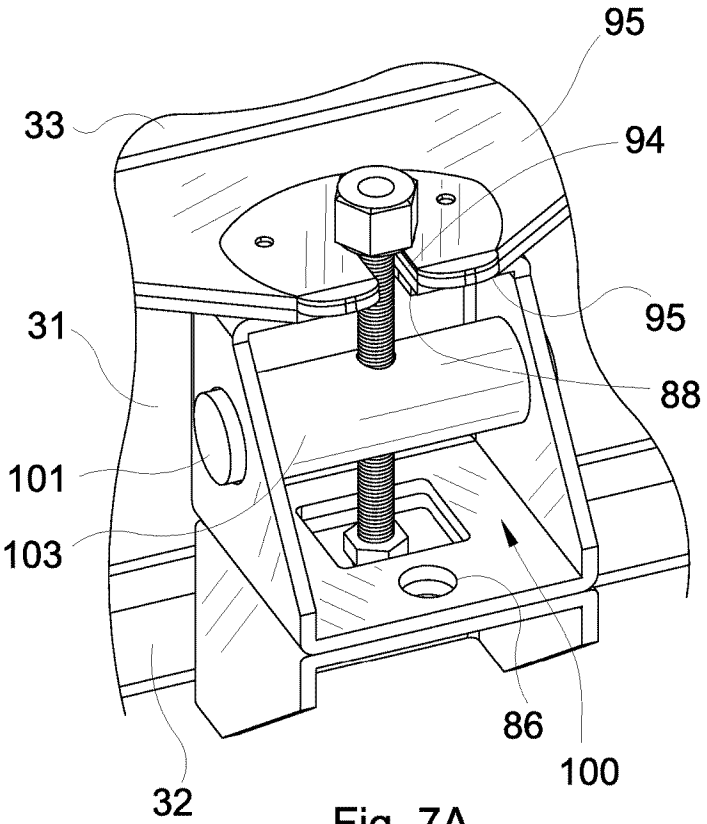
Figure 8A:
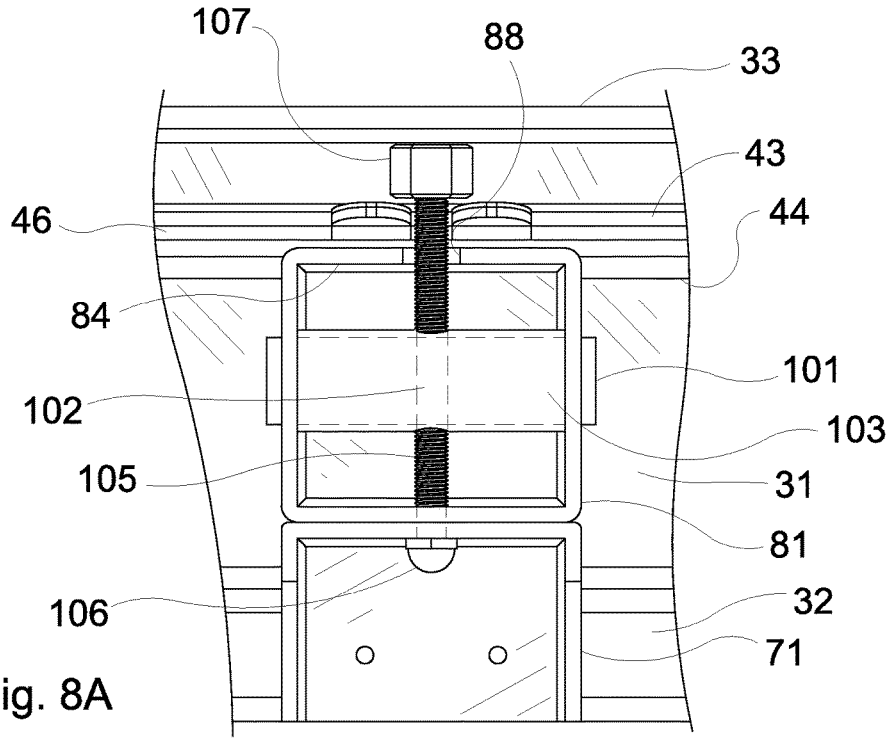
FIGS. 8A, 8B detail a spring washer used with the hold down latch of FIG. 7A.
Figure 8B:
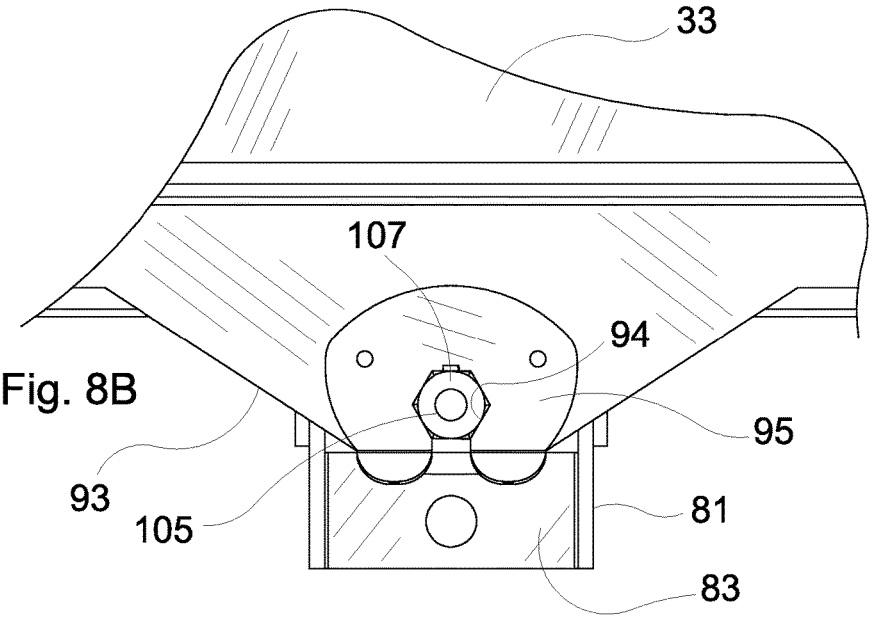
Figures 9A, 9B, 9C:
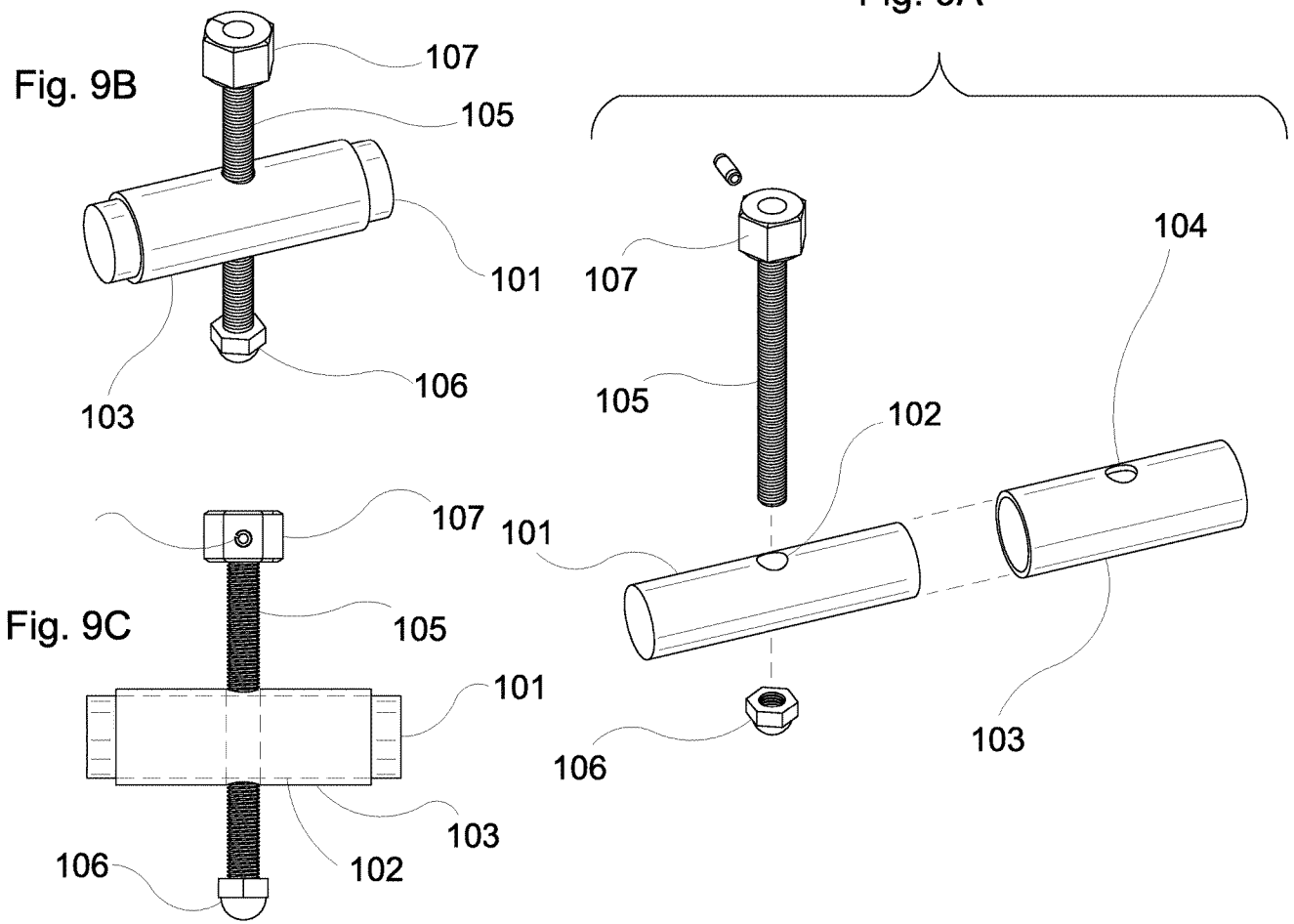
FIGS. 9A-9C detail components of the hold down mechanism of FIG. 7A.

As best seen in FIG. 7A, block 80 may include floor well 87 into which cap 106 extends when nut 107 is tightened during closing of latch 100. This permits shaft 105 to be of sufficient length that, when latch 100 is to be opened, nut 107 can be unscrewed enough to clear flare 93 even at the perigee of the concave-downward arch built into flange 43 and upwardly concave shape of nose 96. Well 87 further aligns with congruent aperture 77 in flange 73 of lug 70 so that cap 106 may extend there through as needed. See FIGS. 7A, 7C.

In operation, lid 33 is lowered to close antenna farm 30 until lip 41 engages inner lid gasket 46, initially just at the corners of lid 33 because of the slightly concave-downward arch of lid 33. Latches 100 are all opened (as shown in FIG. 7B) and shafts 105 extended upward enough that nut 107 can clear flare 93 when needed. The operator (not shown) then presses down on lid 33 at approximately its midpoint opposite hinge 35 until he can close latch 100, disposed at that point on base 31, by pivoting shaft 105 into its vertical position (FIG. 7A) from its angled, open position (FIG. 7B) with shaft 105 admitted into slots 88, 94 and nut 107 disposed above flare 93. The operator then rotates nut 107 to bring flange 43 of lid 33 closer to shelf 44 until he can see that flange 43 is engaged with gasket 46 substantially all the way around base 31. If top 84 is provided on lug 81, the operator will feel a solid engagement of flange 43 with top 84 and know that lid 33 is closed. The operator then closes in like manner the other latches 100 around the perimeter of enclosure 30 to secure enclosure 30 closed. To open enclosure 30, the operator simply reverses the above steps.

Thus, antenna farm 30 provides a greatly improved enclosure for cabling 14 leading from antennae 13 into cab 3. Double gasketing with gaskets 45, 46 creates a better seal between lid 33 and base 31 than in the prior art. Adjustable mounts 70 accommodate irregularities in roof 4 of engine 2, while chimney 60 extends upward into interior 30A of antenna farm 30 to prevent accumulated moisture within base 31, and any moisture below base 31, from entering cab 3. Bolted hinge 35 enables removal of lid 33 entirely from base 31 and enables convenient servicing of antennae 13 at a remote site, instead of requiring such service to be performed on the top of engine 2. Hold down means 80, 100 provides reliable, convenient and strong closure of lid 33 without risking loss of small parts of latch 100.

While the invention has been particularly shown and described with reference to preferred and alternate embodiments, it will be understood by those skilled in the art that various changes in form and detail may be made therein without departing from the spirit and scope of the invention. For example, the novel features of the present invention have been discussed in the context of an antenna farm atop a locomotive engine cab. However, the features of a bolted hinge, double gasketing and latch system 100 also could be applied to other enclosures, with or without the need for ingress and egress for cabling 14. Further, the comparatively flat dimensions of antenna farm 30 are not necessary for the proper functioning of such an enclosure, which could be substantially taller relative to its base (not shown) than that for antenna farm 30.

We claim:

1. An antenna farm for a locomotive cab having a cab interior and a cab roof surrounding and defining at least one cab cable channel communicating between said cab interior and said cab roof, said antenna farm adapted to mount upon said cab roof and to bear one or more antennae coupled by antenna cabling to electronic devices within said cab interior, said antenna farm comprising a frame bolted to said cab roof and having a roof-engaging surface and an opposite frame top surface;

a frame perimeter wall extending between said roof-engaging surface and said frame top surface; and means for leveling the frame on the cab roof;

a base congruent with said frame and disposed on said frame top surface, said base surrounding and defining an antenna farm enclosure, said base having a substantially planar enclosure floor surrounding and defining at least one access port, each of said at least one access ports aligned with and coupled to one of said at least one cab cable channels; and at least three substantially vertical base perimeter walls extending normal to said enclosure floor and intersecting to form at least three perimeter wall corners;

a lid hingedly coupled to a first one of said at least three base perimeter walls and adapted to articulate between an open lid position and a closed lid position disposed atop said base perimeter wall, said lid having a lid bottom adjacent to said enclosure and an opposite lid top bearing said antennae; and a plurality of antenna cable battens disposed on said lid bottom and adapted to affix cables extending from said antennae through said antenna farm enclosure toward said cab interior;

means for coupling the base to the frame;

means for latching the lid to the base; and means for interfacing between said enclosure and said cab interior.

2. The antenna farm of claim 1 wherein the means for leveling comprises one or more shim spacers disposed between said roof-engaging surface and said cab roof at selected locations around the frame perimeter, said shim spacers surrounding bolts holding said frame to said cab roof.

3. The antenna farm of claim 1 wherein said means for coupling comprises a plurality of mount blocks disposed around said frame outer perimeter wall, each mount block having two frame gussets disposed normal to said cab roof a spaced distance apart and supporting a substantially horizontal mount flange;

two block gussets disposed on said base perimeter wall directly above said frame gussets and supporting a block floor substantially coextensive with and juxtaposed to said horizontal mount flange; and means for fastening said block floor to said mount flange.

4. The antenna farm of claim 3 wherein the means for fastening comprises a mount bolt aperture surrounded and defined by said horizontal mount flange;

block floor bolt aperture surrounded and defined by said block floor and disposed coaxial with said mount bolt aperture; and a bolt coupled through said mount bolt aperture and said block floor bolt aperture.

5. The antenna farm of claim 1 wherein said means for interfacing comprises at least one chimney communicating between one of said at least one cab cable channel and one of said at least one access port, each of said at least one chimney having a perimeter flange surrounding said at least one cab cable channel and sealed to said cab roof;

at least one chimney wall extending vertically upward from said perimeter flange and into said at least one access port a spaced distance above said enclosure floor to terminate a spaced distance below said lid bottom; and a seal surrounding said at least one chimney wall within said at least one access port, whereby said antenna cabling extends between said chimney wall and said lid bottom to enter said cab interior from said antenna farm enclosure.

6. The antenna farm of claim 1 wherein the base planar floor further surrounds and defines a plurality of weep holes communicating between said antenna farm enclosure and said cab roof; and weep hole screens are disposed across said weep holes and sized selectively to prevent intrusion into said enclosure by fauna.

7. The antenna farm of claim 1 wherein said means for latching comprises a plurality of latch blocks disposed on said base perimeter wall a spaced distance apart, each of said latch blocks having two vertical latch block gussets disposed substantially normal to said cab roof, each of said latch block gussets surrounding and defining an axle aperture having an aperture axis parallel to said base perimeter wall;

a plurality of flares disposed on the lid, one each of said plurality of flares disposed above each of said plurality of latch blocks, said flares having a flare top and a flare bottom;

a flare nose disposed opposite the lid;

a flare slot communicating between said flare top and said flare bottom and extending from said flare nose toward said lid a spaced distance;

a hold down latch pivotally disposed between said latch block gussets and having a transverse axle journaled in and coaxial with said axle apertures, said transverse axle surrounding and defining a transverse threaded shaft bore;

a collar surrounding said transverse axle between said latch block gussets;

a threaded shaft extending through said threaded shaft bore, said threaded shaft having an upper shaft end and a lower shaft end, said threaded shaft adapted to pivot about said aperture axis to articulate between a closed latch position disposed within said flare slot and an open latch position; and a tightening nut affixed to said upper shaft end and adapted to enable turning of said threaded shaft within said threaded shaft bore to cause said tightening nut bear upon said flare nose when said threaded shaft is in said closed latch position.

8. The antenna farm of claim 7 and further comprising a keeper cap disposed on said threaded shaft opposite said tightening nut.

9. The antenna farm of claim 7 wherein said flare nose is concave upward away from said cab roof.

10. The antenna farm of claim 7 and further comprising slotted flare washer disposed atop said flare nose.

11. The antenna farm of claim 1 wherein said base perimeter wall includes an upper base rim having a base rim length between each pair of adjacent corners of said base perimeter wall;

an inwardly extending base wall shelf disposed a spaced distance below said base rim; and a base shelf gasket disposed on said base wall shelf; and said lid includes a downwardly extending lid rim positioned above said base wall shelf and having a lid rim length extending between each pair of adjacent corners of said base perimeter wall;

a lid gasket disposed on said lid bottom above said upper base rim;

whereby said lid rim engages said base shelf gasket and said upper base rim engages said lid gasket when said lid is in said closed lid position.

12. The antenna farm of claim 11 wherein said lid rim is concave downward toward said upper base rim along its lid rim length; and said means for latching is adapted to compress and flatten said lid rim along the entirety of its lid rim length between each of said at least three perimeter wall corners.

13. An enclosure adapted to mount on a vehicle, the vehicle having a vehicle interior, a vehicle roof and a vehicle cable channel communicating between said vehicle interior and said vehicle roof, said enclosure comprising a frame disposed on and coupled to said vehicle roof;

a base congruent with and mounted to said frame, the base having a planar base floor with an access port aligned with said vehicle cable channels; and a base perimeter wall having upper perimeter wall rim and extending normal to said planar base floor, the perimeter wall and the base floor defining an enclosure interior;

a chimney coupled to said vehicle roof surrounding said vehicle cable channel and extending upward through said access port a spaced distance above said planar floor;

a lid bearing said antennae and hingedly coupled to the perimeter wall, the lid adapted to articulate between an open lid position providing access to said enclosure interior and a closed lid position disposed a spaced distance above the chimney, the lid having a lid perimeter congruent with the base perimeter wall and bearing a plurality of outwardly extending flares, each of said flares having an outwardly opening flare slot; and a plurality of hold down latches arrayed around the base perimeter wall beneath each of said plurality of outwardly extending flares, the latches adapted to pivot between a closed latch position when said lid is closed and an open latch position, each latch having an axle pivotally extending through a pair of lug gussets disposed on the base perimeter wall;

a transverse threaded shaft extending upwardly toward said flare to terminate in a tightening nut, said threaded shaft adapted to journal within said flare slot with said tightening nut bearing against said flare; and a collar coaxial with and surrounding the axle and disposed along a length of the axle between said pair of lug gussets, said collar penetrated by said transverse threaded shaft.

14. The antenna enclosure of claim 13 wherein each of the plurality of hold down latches further comprises a cap nut on the threaded shaft opposite the tightening nut.

15. An improved method of mounting an antenna farm to a locomotive cab, the locomotive cab having a cab roof, a cab interior and a cable channel, the improved method comprising providing an antenna farm enclosure having a base having a planar base floor and vertical base perimeter walls surrounding said base floor and defining an enclosure interior;

a lid bearing a plurality of antennae coupled to antennae cables, said lid hingedly coupled to said base perimeter walls, said lid having a lid perimeter and a plurality of flares extending outward from said lid perimeter above said base perimeter walls, each of said flares having an outwardly opening flare slot;

an access port disposed above said cable channel and communicating between said enclosure interior and said cab interior;

a chimney coupled to said cab roof surrounding said cable channel and adapted to extend through said access port to terminate a spaced distance below said lid; and a plurality of hold down latches having pivot blocks mounted to said base perimeter walls beneath each of said plurality of flares on said lid;

an axle extending through said pivot blocks;

a shaft extending transverse said axle to journal within said flare slot;

providing a frame adapted to interface between said planar base floor and said cab roof, said frame having a plurality of shim spacers adapted to level said frame on said cab roof;

providing a plurality of frame mounting bolts coupled said cab roof; then positioning said frame onto said cab roof with said frame mounting bolts extending into said frame; then leveling said frame by selectively placing said shim spacers between said frame and said cab roof; then coupling said base to said frame with said chimney aligned with said cable channel; then extending said antennae cables through said enclosure interior, said chimney and said cable channel and into said cab interior; then closing said lid and said plurality of hold down latches to seal said enclosure interior.

16. An antenna farm for a locomotive cab having a cab interior and a cab roof surrounding and defining at least one cab cable channel communicating between said cab interior and said cab roof, said antenna farm adapted to mount upon said cab roof and to bear one or more antennae coupled by antenna cabling to electronic devices within said cab interior, said antenna farm comprising a frame bolted to said cab roof and having a roof-engaging surface and an opposite frame top surface;

a frame perimeter wall extending between said roof-engaging surface and said frame top surface; and means for leveling the frame on the cab roof;

a base congruent with said frame and disposed on said frame top surface, said base surrounding and defining an antenna farm enclosure, said base having a substantially planar enclosure floor surrounding and defining at least one access port, each of said at least one access ports aligned with and coupled to one of said at least one cab cable channels; and a plurality of weep holes communicating between said antenna farm interior and said cab roof; and weep hole screens disposed across said weep holes and sized selectively prevent intrusion into said enclosure interior by fauna;

at least three substantially vertical base perimeter walls extending normal to said enclosure floor and intersecting to form at least three perimeter wall corners;

a lid hingedly coupled to a first one of said at least three base perimeter walls and adapted to articulate between an open lid position and a closed lid position disposed atop said base perimeter wall, said lid having a lid bottom adjacent to said enclosure and an opposite lid top bearing said antennae;

means for coupling the base to the frame;

means for latching the lid to the base; and means for interfacing between said enclosure and said cab interior.

17. An antenna farm for a locomotive cab having a cab interior and a cab roof surrounding and defining at least one cab cable channel communicating between said cab interior and said cab roof, said antenna farm adapted to mount upon said cab roof and to bear one or more antennae coupled by antenna cabling to electronic devices within said cab interior, said antenna farm comprising a frame bolted to said cab roof and having a roof-engaging surface and an opposite frame top surface;

a frame perimeter wall extending between said roof-engaging surface and said frame top surface; and means for leveling the frame on the cab roof;

a base congruent with said frame and disposed on said frame top surface, said base surrounding and defining an antenna farm enclosure, said base having a substantially planar enclosure floor surrounding and defining at least one access port, each of said at least one access ports aligned with and coupled to one of said at least one cab cable channels; and at least three substantially vertical base perimeter walls extending normal to said enclosure floor and intersecting to form at least three perimeter wall corners, each of said base perimeter walls having an upper base rim having a base rim length between each pair of adjacent corners of said base perimeter wall;

an inwardly extending base wall shelf disposed a spaced distance below said base rim; and a base shelf gasket disposed on said base wall shelf;

a lid hingedly coupled to a first one of said at least three base perimeter walls and adapted to articulate between an open lid position and a closed lid position disposed atop said base perimeter wall, said lid having a lid bottom adjacent to said enclosure and an opposite lid top bearing said antennae;

a downwardly extending lid rim positioned above said base wall shelf and having a lid rim length extending between each pair of adjacent corners of said base perimeter wall;

a lid gasket disposed on said lid bottom above said upper base rim;

whereby said lid rim engages said base shelf gasket and said upper base rim engages said lid gasket when said lid is in said closed lid position;

means for coupling the base to the frame;

means for latching the lid to the base; and means for interfacing between said enclosure and said cab interior.

18. The antenna farm of claim 17 wherein said lid rim is concave downward toward said upper base rim along its lid rim length; and said means for latching is adapted to compress and flatten said lid rim along the entirety of its lid rim length between each of said at least three perimeter wall corners.

19. An antenna farm for a locomotive cab having a cab interior and a cab roof surrounding and defining at least one cab cable channel communicating between said cab interior and said cab roof, said antenna farm adapted to mount upon said cab roof and to bear one or more antennae coupled by antenna cabling to electronic devices within said cab interior, said antenna farm comprising a frame bolted to said cab roof and having a roof-engaging surface and an opposite frame top surface;

a frame perimeter wall extending between said roof-engaging surface and said frame top surface; and means for leveling the frame on the cab roof;

a base congruent with said frame and disposed on said frame top surface, said base surrounding and defining an antenna farm enclosure, said base having a substantially planar enclosure floor surrounding and defining at least one access port, each of said at least one access ports aligned with and coupled to one of said at least one cab cable channels; and at least three substantially vertical base perimeter walls extending normal to said enclosure floor and intersecting to form at least three perimeter wall corners;

a lid hingedly coupled to a first one of said at least three base perimeter walls and adapted to articulate between an open lid position and a closed lid position disposed atop said base perimeter wall, said lid having a lid bottom adjacent to said enclosure and an opposite lid top bearing said antennae;

a plurality of mount blocks disposed around said frame outer perimeter wall, each mount block having two frame gussets disposed normal to said cab roof a spaced distance apart and supporting a substantially horizontal mount flange;

two block gussets disposed on said base perimeter wall directly above said frame gussets and supporting a block floor substantially coextensive with and juxtaposed to said horizontal mount flange; and means for fastening said block floor to said mount flange;

means for latching the lid to the base; and means for interfacing between said enclosure and said cab interior.

20. The antenna farm of claim 19 wherein the means for fastening comprises a mount bolt aperture surrounded and defined by said horizontal mount flange;

block floor bolt aperture surrounded and defined by said block floor and disposed coaxial with said mount bolt aperture; and a bolt coupled through said mount bolt aperture and said block floor bolt aperture.

21. An antenna farm for a locomotive cab having a cab interior and a cab roof surrounding and defining at least one cab cable channel communicating between said cab interior and said cab roof, said antenna farm adapted to mount upon said cab roof and to bear one or more antennae coupled by antenna cabling to electronic devices within said cab interior, said antenna farm comprising a frame bolted to said cab roof and having a roof-engaging surface and an opposite frame top surface;

a frame perimeter wall extending between said roof-engaging surface and said frame top surface; and means for leveling the frame on the cab roof;

a base congruent with said frame and disposed on said frame top surface, said base surrounding and defining an antenna farm enclosure, said base having a substantially planar enclosure floor surrounding and defining at least one access port, each of said at least one access ports aligned with and coupled to one of said at least one cab cable channels; and at least three substantially vertical base perimeter walls extending normal to said enclosure floor and intersecting to form at least three perimeter wall corners;

a lid hingedly coupled to a first one of said at least three base perimeter walls and adapted to articulate between an open lid position and a closed lid position disposed atop said base perimeter wall, said lid having a lid bottom adjacent to said enclosure and an opposite lid top bearing said antennae;

means for coupling the base to the frame;

a plurality of latches adapted to couple the lid to the base, each of the latches having a latch block disposed on said base perimeter wall and having two vertical latch block gussets disposed substantially normal to said cab roof, each of said latch block gussets surrounding and defining an axle aperture having an aperture axis parallel to said base perimeter wall;

a flare disposed on the lid above the latch block, said flare having a flare top and a flare bottom;

a flare nose disposed opposite the lid;

a flare slot communicating between said flare top and said flare bottom and extending from said flare nose toward said lid a spaced distance;

a hold down pivotally disposed between said latch block gussets and having a transverse axle journaled in and coaxial with said axle apertures, said transverse axle surrounding and defining a transverse threaded shaft bore;

a collar surrounding said transverse axle between said latch block gussets;

a threaded shaft extending through said threaded shaft bore, said threaded shaft having an upper shaft end and a lower shaft end, said threaded shaft adapted to pivot about said aperture axis to articulate between a closed latch position disposed within said flare slot and an open latch position; and a tightening nut affixed to said upper shaft end and adapted to enable turning of said threaded shaft within said threaded shaft bore to cause said tightening nut bear upon said flare nose when said threaded shaft is in said closed latch position; and means for interfacing between said enclosure and said cab interior.

22. The antenna farm of claim 21 and further comprising a keeper cap disposed on said threaded shaft opposite said tightening nut.

23. The antenna farm of claim 21 wherein said flare nose is concave upward away from said cab roof.

24. The antenna farm of claim 21 and further comprising slotted flare washer disposed atop said flare nose.

25. An antenna farm for a locomotive cab, the locomotive cab having a cab interior and a cab roof surrounding and defining at least one cab cable channel communicating between said cab interior and said cab roof, said antenna farm adapted to mount above said cab roof and to bear one or more antennae coupled by antenna cabling to electronic devices within said cab interior, said antenna farm comprising an antenna farm enclosure adapted to entirely enclose said antenna cabling between said antennae and said at least one cab cable channel, said enclosure having an enclosure interior defined by an enclosure perimeter surrounded by at least three enclosure walls;

a substantially planar enclosure floor extending between said at least three enclosure walls, the enclosure floor surrounding and defining at least one access port, said enclosure floor adapted to be disposed a spaced distance above said cab roof with each of said at least one access port aligned with and coupled to one of said at least one cab cable channels; and a lid hingedly coupled to a first one of said at least three enclosure walls and adapted to articulate between an open lid position and a closed lid position disposed atop said perimeter walls, said lid having a lid bottom adjacent to said enclosure and an opposite lid top bearing said antennae; and at least one chimney communicating between one of said at least one cab cable channel and one of said at least one access port, each of said at least one chimney having a perimeter flange surrounding said at least one cab cable channel and sealed to said cab roof;

at least three chimney walls extending vertically upward from said perimeter flange and through said at least one access port and into said enclosure interior a first select distance above said enclosure floor to terminate a second select distance below said lid bottom; and a seal surrounding said at least three chimney walls within said at least one access port; and means for coupling said enclosure floor to said cab roof;

whereby wind and water pass through said spaced distance between said enclosure floor and said cab roof without entering said at least one cab cable channel.

26. The antenna farm of claim 25 wherein said means for coupling comprises a frame bolted to said cab roof and having a roof-engaging surface and an opposite frame top surface;

a frame perimeter wall extending between said roof-engaging surface and said frame top surface; and means for leveling the frame on the cab roof whereby said frame displaces said enclosure floor above said cab roof a distance equivalent to said spaced distance.

27. The antenna farm of claim 25 wherein the enclosure floor further surrounds and defines a plurality of weep holes communicating between said enclosure interior and said spaced distance; and weep hole screens are disposed across said weep holes and sized selectively to prevent intrusion into said enclosure interior by fauna.

* * * * *